US005704231A

United States Patent [19]

Heald

[11] Patent Number: 5,704,231

[45] Date of Patent: Jan. 6, 1998

[54] LOCK AND PROTECTIVE COVER ASSEMBLY AND KIT FOR THE SAME

[76] Inventor: Charles J. Heald, 332 Stillwater Dr., Dayton, Nev. 89403

[21] Appl. No.: 589,364

[22] Filed: Jan. 22, 1996

[51] Int. Cl.[6] ..... E05B 67/38

[52] U.S. Cl. ..... 70/54; 70/55; 70/424; 70/455

[58] Field of Search ..... 70/54–56, 454, 70/455, 423, 424

[56] References Cited

U.S. PATENT DOCUMENTS

| | | | |
|---|---|---|---|
| 1,333,355 | 3/1920 | Voight | 70/54 |
| 1,662,612 | 3/1928 | Junkunc | 70/55 |
| 3,858,419 | 1/1975 | Hampton | 70/55 |
| 4,224,813 | 9/1980 | Hampton | 70/55 X |
| 4,226,100 | 10/1980 | Hampton et al. | 70/55 X |
| 4,286,445 | 9/1981 | Sills | 70/55 |
| 4,297,861 | 11/1981 | Dykes | 70/55 |
| 4,317,344 | 3/1982 | Barnard | 70/55 |
| 4,651,543 | 3/1987 | Heald et al. | 70/54 |
| 5,156,029 | 10/1992 | Heald | 70/55 |

*Primary Examiner*—Suzanne Dino
*Attorney, Agent, or Firm*—John J. Posta, Jr.

[57] ABSTRACT

The improved padlock and protective cover assembly includes a flexible resilient cover of natural or elastomeric material releasably disposed around the body of a padlock. The hasp, including its rungs, project up and out of the top of the cover. The cover top is removable from the lower portion of the cover and fits snugly around the rungs to prevent water from contacting the padlock body. That body is disposed snugly within an open-topped insert, the insert also fitting snugly within the lower portion of the cover. Both the insert bottom and the bottom of the lower portion of the cover define an opening up through which a key can be inserted into the lock body to release the hasp. The opening in the cover lower portion bottom is normally closed but can be flexed open. In one embodiment that bottom is specially configured as an upwardly projecting arc to facilitate squeezing the opposite sides of the bottom toward each other to flex open the keyhole. A further embodiment relates to a kit containing the cover lower portion, padlock and a number of tops and inserts to accommodate padlocks of differing dimensions. The multiple components of the assembly and kit are simple and inexpensive to make and use.

6 Claims, 1 Drawing Sheet

LOCK AND PROTECTIVE COVER ASSEMBLY AND KIT FOR THE SAME

BACKGROUND OF THE INVENTION

1. Field of The Invention

The present invention generally relates to locks and protective means for the same and more particularly relates to an improved padlock and cover assembly and to a kit for the same.

2. Prior Art

Various covers have been manufactured to protect locks such as padlocks from the elements. Most of such covers have been made of non-corrodable metal, such as aluminum, magnesium or titanium, or of stiff inflexible plastic. Such plastic is notorious for cracking when long exposed to moisture, sun and heat.

Metallic covers are necessarily stiff and, like stiff plastic, unable to conform to the contours of a padlock, and to closely fit around various sizes of padlocks in order to prevent moist air from corroding the padlock body. Moreover, such covers are relatively expensive and difficult to install and remove. They usually are two-piece clamshells spring hinged together. See U.S. Pat. Nos. 4,317,344, 3,848,440, 4,224,813 and 3,983,725 for representative examples of such covers. Springs used in such devices tend to corrode rapidly. Moreover, such devices must be opened in order to have access to the lock. In cold weather, in rain and in snow, this can be difficult.

A newer form of lock-protecting cover is disclosed in U.S. Pat. No. 4,651,543. Such cover is of resilient flexible plastic or the like, is of a unitary construction and provides easy access to the keyhole of the lock without having to remove the cover. However, even that improved cover has certain disadvantages. Thus, it is relatively difficult to mold or otherwise form. Moreover, if a padlock or the like substantially smaller than the cover is disposed in the cover, the lock rattles around inside the cover and the cover keyhole may be difficult to align with the lock keyhole in order to release the lock hasp.

Accordingly, there is a need for a simple, inexpensive, easy to make and use all-weather padlock protective cover and for a kit adapted to accommodate such a cover to various sizes of padlocks.

SUMMARY OF THE INVENTION

The improved padlock and cover assembly of the present invention and the improved kit of the present invention satisfy all the foregoing needs. The assembly and kit are substantially as set forth in the ABSTRACT OF THE DISCLOSURE.

Thus, the cover of the assembly comprises a removable top having a spaced pair of hasp rung openings, a cover lower portion defining a generally central space and an insert snugly fitting within the cover space and within which the padlock snugly fits. The cover top is releasably disposed over the open upper end of the cover lower portion and insert. Both the bottom of the cover lower portion and the bottom of the insert define a keyhole up through which a key can be inserted into the lock to open the hasp. The hasp extends up through the cover top to a position above the cover. The lock is removable from the insert and the insert is removable from the cover lower portion.

In one aspect of the invention, a kit is provided which includes a cover lower portion, a padlock, a plurality of tops having hasp rung openings of different diameters and a plurality of inserts of differing internal dimensions to snugly fit padlocks of various sizes. It will be understood that, if desired, the kit can exclude the padlock itself. Such kit is capable of being adapted for use with padlocks of various sizes.

Since the cover top, cover lower portion and inserts are separate from one another, they can be easily and inexpensively made and easily assembled together for use. The wall thickness of the insert can vary, in order to vary the size of its padlock-receiving internal space. Moreover, the cover lower portion can be of a special configuration to facilitate flexing open the normally closed keyhole. For this purpose, the bottom can have two opposing side margins which depend below the remainder of the bottom. One form of the bottom has a curved configuration, the bottom arcing upwardly from the depending side margins to a central high point in the area of the keyhole. This facilitates rapid drainage of moisture down away from the keyhole.

Further features of the improved assembly and kit of the present invention are set forth in the following detailed description and accompanying drawings.

DRAWINGS

DETAILED DESCRIPTION

FIGS. 1–5 and 7–9.

Figure 7:
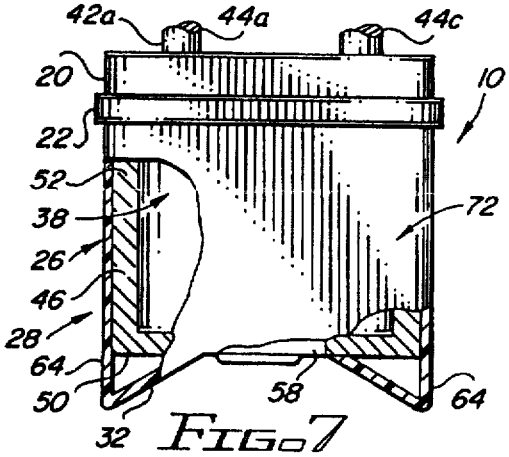
FIG. 7 is a schematic side elevation, partly broken away, of the cover of FIG. 5 and the first embodiment of the improved assembly of the present invention.
Figure 9:
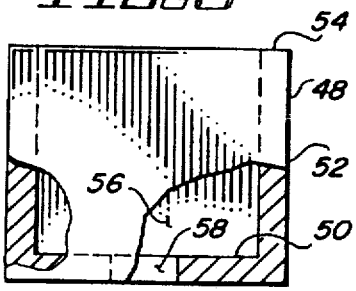
Figure 8:
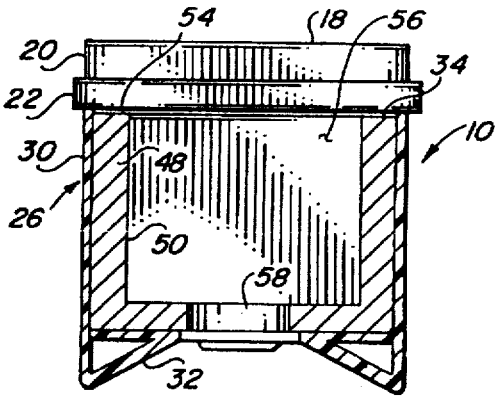
FIG. 8 is a schematic side elevation, partly broken away, of the cover of FIG. 7, but with a second preferred embodiment of the insert of the present invention; and, FIG. 9 is a schematic side elevation, partly broken away, of the insert of FIG. 8.

Now referring more particularly to FIGS. 1–5 and 7–9 of the drawings, a first preferred embodiment of the improved lock cover kit of the present invention is shown, including three separate cover tops, a cover bottom, and two cover bottom inserts, one in FIG. 7 and the other in FIGS. 8 and 9. The kit may also include a lock such as a padlock.

Thus, kit 10 is shown which comprises three cover tops 12, 14 and 16 which differ from one another only in the diameter and spacing of a pair of lock hasp openings therein. Thus, each top 12, 14 and 16 has a generally rectangular horizontal upper end 18 with vertically depending sidewalls 20 terminating in an expanded lower rim 22. End 18, sidewalls 20 and rim 22 collectively define a central space 24.

Kit 10 also includes a lower cover portion 26 which with any of tops 12, 14 and 16 forms lock cover 28. Portion 26 is also generally rectangular with vertical sidewalls 30 connected to a bottom 32 to define a central space 34 communicating with an open upper end 36 of portion 26.

Rim 22 is releasably sealingly seated over the upper edges of sidewalls 30 so that top 12 (or alternatively top 14 or 16) releasably closes portion 26 to seal lock cover 28 against ingress of rain, snow, other moisture, dirt, sand, etc. Lock cover 28 can be easily opened by lifting off top 12, 14 or 16 for access to space 34.

Kit 10 preferably also includes a lock such as a conventional padlock 38 having a body 40 with bottom key access hole (not shown) and a top generally inverted U-shaped hasp 42 comprising a spaced pair of rungs 44 projecting above body 40. As shown in FIG. 7, body 40 is generally rectangular and smaller in dimensions than lower cover portion 26. If desired, lock 38 can be left out of kit 10.

Kit 10 further includes at least two different inserts, one of which, insert 46, as shown in FIG. 7 and the other of which, insert 48, is shown in FIG. 8. Inserts 46 and 48 are substantially identical, except that the wall thickness of insert 48 is larger than that of insert 46. Inserts 46 and 48 are generally rectangular, conforming to the configuration of lower cover portion 26 and adapted to snugly but removably fit into space 34. Thus, each of inserts 46 and 48 has a flat horizontal bottom 50 joined to spaced vertical sidewall 52 and an open upper end 54. Bottom 50 and sidewalls 52 colletively define a central padlock-receiving space 56.

Bottom 50 has a central opening 58 extending therethrough and aligned with a similar opening 60 in bottom 32 of portion 26 Insert 46 is adapted to snugly but releasably fit around the body 40 of padlock 38, holding it in place in space 56 and therefore in space 34 with the bottom padlock keyhole aligned with openings 58 and 60 so that a key can be inserted into padlock 38 without removing it from cover 28.

It will be understood that cover 28 and inserts 46 and 48 are resilient and flexible with elastic memory. They can be formed of any suitable elastomeric compound or compounds such as natural or synthetic rubber or plastic. Their shape and size will vary, depending on the dimensions and shape of padlock 38. Preferably, opening 60 is normally closed and may include one or a pair of depending lips 62 to protect opening 60 from ingress of moisture.

Bottom 32 is preferably specially configured to facilitate flexing lips 62 open to expose opening 60 so that a key can be inserted therethrough. Bottom 32 and sidewalls 30 have elastic memory, so that upon relaxation of flexing pressure, lips 62 close opening 60. Thus, two opposite sidewalls 30 may include a pair of legs 64 which extend below the level of the central opening 60 in bottom 32. Legs 64 are interconnected by bottom 32 which is in the form of a lobe-shaped arc, with its high point in the area of opening 60. Pressing legs 64 toward each other flexes lips 62 apart, exposing opening 60.

It will be noted that cover tops 12, 14 and 16 are identical, except for the diameter and location of a spaced pair of openings 66 and 68 in tops 12, 14 and 16. The particular top to be used is selected so that openings 66 and 68 snugly but releasably fit around rungs 44, sealing the top against ingress of moisture into spaces 34 and 56.

Openings 66 and 68 are preferably joined by a closed openable slit 70 so that hasp 42 can be pushed up therethrough to seat rungs 44 in openings 66 and 68, after which padlock body 40 is seated in insert 56 and 48 while that insert is seated in space 34 in lower cover portion 26. Top 12, 14 or 16, whichever one is being used, is then seated on the upper edges of sidewalls 30 to close cover 28 to the finished operative position shown in FIG. 7. It will be understood that cover 28, insert 46 or 48 (as desired) and padlock 38 form the improved cover assembly 72 of the present invention.

Kit 10 and cover assembly 72 have substantial advantages over the prior art, being easily fabricated, assembled and used with superior results.

FIG. 6.

Figure 1:
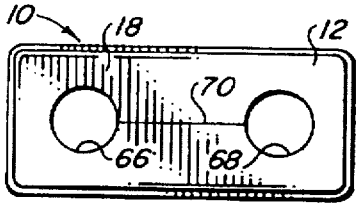
FIG. 1 is a schematic top plan view of a first preferred embodiment of the cover top of the improved kit of the present invention.
Figure 2:
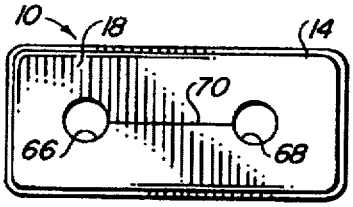
FIG. 2 is a schematic top plan view of a second preferred embodiment of the cover top of the improved kit of the present invention.
Figure 3:
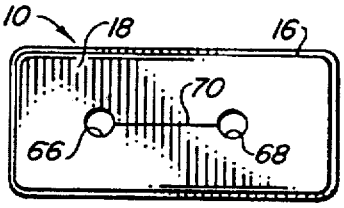
FIG. 3 is a schematic top plan view of a third preferred embodiment of the cover top of the improved kit of the present invention.
Figure 4:
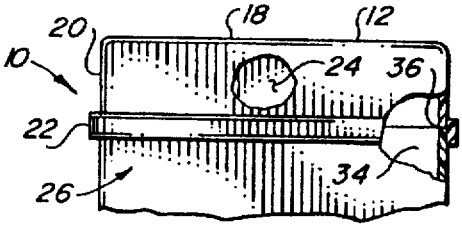
FIG. 4 is a fragmentary schematic side elevation, partly broken away, showing one of the tops of FIGS. 1–3 disposed on the open upper end of a preferred embodiment of the lower portion of the padlock cover of the present invention.
Figure 5:
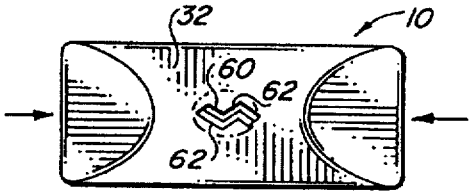
FIG. 5 is a schematic bottom plan view of the cover of FIG. 4.
Figure 6:
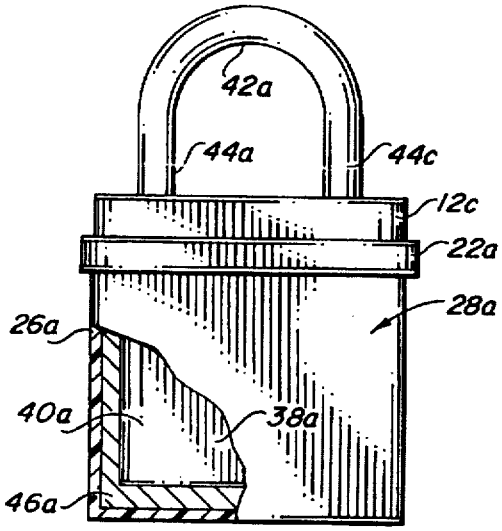
FIG. 6 is a schematic side elevation, partly broken away, of a second preferred embodiment of the improved cover of the present invention and the improved assembly of the present invetnion.

A second preferred embodiment of the improved assembly of the present invention is schematically set forth in FIG. 6. Thus, assembly 72*a* is shown. Components thereof similar to those of assembly 72 bear the same numerals but are succeeded by the letter "a".

Assembly 72*a* is substantially identical to assembly 72, except that bottom 32*a* is flat and horizontal, having no depending legs such as legs 64, and no lips but is nevertheless capable of being flexed to open its bottom keyhole. Assembly 72*a* has the other advantages of assembly 72.

Various modifications, changes, alterations and additions can be made in the improved assembly and kit of the present invention, their components and parameters. All such modifications, changes, alterations and additions as are within the scope of the appended claims form part of the present invention.

What is claimed is:

1. An improved padlock cover kit, said kit comprising, in combination:

a) a padlock having a lock body with a bottom key opening and a generally inverted U-shaped hasp with a pair of spaced depending rungs extending into said lock body; and, b) a padlock cover assembly, said assembly comprising:

i. a flexible resilient lower cover portion having a closed bottom defining an openable padlock key opening, upstanding spaced closed sidewalls connected to said bottom and defining therewith a generally central space, said lower cover portion having an open upper end, ii. a plurality of removable tops, each said top having a spaced pair of hasp rung openings extending down therethrough, said tops differing from one another in the diameter of said hasp rung openings so as to accommodate padlocks having different size rungs, each said top being seatable on said upper end of said lower portion to releasably close said padlock cover, and, iii. a plurality of inserts, each said insert being dimensioned to fit snugly in said lower portion, and having spaced interconnecting sidewalls and bottom, said bottom having an opening alignable with said key opening, said inserts differing from each other in sidewall thickness so as to snugly receive padlocks of different dimensions.

2. The improved kit of claim 1 wherein said bottom of said lower portion of said cover is generally flat and said lower portion is generally rectangular.

3. The improved kit of claim 1 wherein said bottom of said lower portion of said cover has two opposed depending side margins and is arcuate therebetween with the central portion of said bottom being above the level of said depending side margins, whereby said bottom can be readily flexed to open said keyhole opening.

4. The improved kit of claim 1 wherein said cover lower portion, said tops and said inserts comprise at least one of natural and synthetic elastomer.

5. An improved padlock and protective cover assembly, said assembly comprising, in combination:

a) a flexible, resilient, closed, lower cover portion having elastic memory, including a closed bottom defining a generally central closed padlock key opening, upstanding spaced closed sidewalls including a pair of depending legs which extend below the level of said generally central key opening, said legs being connected to said bottom, said bottom being in the form of a lobe-shaped upwardly curving arc, with the high point thereof being at said key opening, whereby pressing said legs toward each other releasably flexes said key opening open to accept a key, said sidewalls and bottom defining a generally central space above said bottom and an open upper end;

b) a flexible resilient insert releasably seated in said generally central space and abutting the inner surfaces of said sidewalls and bottom of said lower cover portion, said insert having spaced sidewalls and a bottom interconnected therewith to define a generally central padlock-receiving cavity with an open upper end, said insert bottom having an opening aligned with said keyhole opening;

c) a padlock having a body with a bottom key-receiving opening, said body being snugly but releasably disposed in said cavity with said padlock key-receiving opening aligned with said openings in said insert bottom and lower cover bottom, said padlock having an inverted U-shaped hasp with a pair of depending hasp rungs at the upper end of said body; and, d) a flexible resilient closed cover top releasably seated on said upper end of said lower cover portion, said top defining a spaced pair of openings through which said hasp rungs snugly fit and extend thereabove, said cover being watertight to protect said padlock from moisture in use.

6. The improved assembly of claim 5 wherein said cover lower portion and top and said insert comprise at least one of natural and synthetic elastomer.

* * * * *